US008480422B2

(12) United States Patent
Siahaan et al.

(10) Patent No.: US 8,480,422 B2
(45) Date of Patent: Jul. 9, 2013

(54) CONNECTOR ASSEMBLIES WITH OVERMOLDS

(75) Inventors: Edward Siahaan, San Francisco, CA (US); Cameron Frazier, Chicago, IL (US); John Ardisana, San Francisco, CA (US); Al Golko, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 4 days.

(21) Appl. No.: 13/106,468

(22) Filed: May 12, 2011

(65) Prior Publication Data

US 2011/0312219 A1 Dec. 22, 2011

Related U.S. Application Data

(60) Provisional application No. 61/355,961, filed on Jun. 17, 2010.

(51) Int. Cl.
*H01R 13/52* (2006.01)

(52) U.S. Cl.
USPC ..... 439/278

(58) Field of Classification Search
USPC ..... 439/625, 278, 281, 465, 447, 606, 439/638
See application file for complete search history.

(56) References Cited

U.S. PATENT DOCUMENTS

| | | | | | |
|---|---|---|---|---|---|
| 2,037,630 | A * | 4/1936 | Hudson | 439/281 |
| 3,337,678 | A * | 8/1967 | Stelmak | 174/527 |
| 4,734,059 | A * | 3/1988 | Melugin | 439/620.28 |
| 4,918,420 | A * | 4/1990 | Sexton | 337/205 |
| 4,996,509 | A * | 2/1991 | Bernstein | 337/232 |
| 5,304,074 | A * | 4/1994 | Andre et al. | 439/417 |
| 5,710,695 | A * | 1/1998 | Manteghi | 361/813 |
| 6,037,854 | A * | 3/2000 | Baker et al. | 337/405 |
| 7,150,642 | B1 * | 12/2006 | Bakke et al. | 439/271 |
| 7,309,256 | B2 * | 12/2007 | Alloway et al. | 439/606 |
| 7,390,210 | B2 * | 6/2008 | Corona | 439/281 |
| 7,445,490 | B2 * | 11/2008 | Jacobson | 439/465 |
| 2011/0312219 | A1 * | 12/2011 | Siahaan et al. | 439/625 |

* cited by examiner

*Primary Examiner* — Alexander Gilman
(74) *Attorney, Agent, or Firm* — Kilpatrick Townsend & Stockton LLP

(57) ABSTRACT

This is directed to connector assemblies for electric cables, and methods of manufacturing the same, that may include a body molded about one or more connections made between one or more conductive leads of the electric cable and one or more electrical contacts of the connector assembly. The molded body may provide support to the connections and may maintain the relative positions of the traces for functionally aligning exposed portions of the traces with other connector assemblies.

28 Claims, 8 Drawing Sheets

CONNECTOR ASSEMBLIES WITH OVERMOLDS

CROSS-REFERENCE TO RELATED APPLICATION

This application claims the benefit of U.S. Provisional Patent Application No. 61/355,961, filed Jun. 17, 2010, which is hereby incorporated by reference herein in its entirety.

FIELD OF THE INVENTION

This is directed to electric cable connector assemblies and, more particularly, to such connector assemblies constructed by overmolding a body about connections made between conductive leads of an electric cable and electrical contacts of the connector assembly.

BACKGROUND OF THE DISCLOSURE

An electric cable may include one or more conductive lines or leads (e.g., wires) extending between a first connector assembly and a second connector assembly. Each connector assembly may be configured to electrically couple the conductive leads of the cable to a number of electrical contacts of the connector assembly. The electrical contacts of a connector assembly may be relatively positioned in a particular manner for electrically coupling the conductive leads of a cable to various types of electronic device input/output ("I/O") components that can mate with the connector assembly (e.g., Universal Serial Bus ("USB") connectors, 30-pin connectors, etc.). Known connector assemblies often include a generally planar printed circuit board with conductive traces provided therealong that extend from the electrical contacts, and the conductive leads of the cable are often soldered or otherwise fixed to portions of these traces of the circuit board. However, such an arrangement often provides little to no support for the connections between the conductive leads and the traces of the circuit board.

SUMMARY OF THE DISCLOSURE

Therefore, there are provided connector assemblies, and methods of manufacturing the same, that may include a body or shell overmolded about one or more connections between conductive leads of an electric cable and electrical contacts of the connector assembly.

For example, according to some embodiments, there is provided a method for constructing a connector assembly for a cable. The method may include electrically coupling a first conductive lead of the cable to a first conductive trace of the connector assembly. The method may also include injecting a first material into a mold cavity for forming a molded body about at least a portion of the first conductive lead and about at least a portion of the first conductive trace. In some embodiments, the method may also include electrically coupling a conductive electronic component to the first conductive trace and to a second conductive trace of the connector assembly. The conductive electronic component may include at least one of a thermal fuse, a thermal cut off ("TCO"), a resistor, and a capacitor. Additionally or alternatively, the method may also include inserting the molded body into a cavity of a connector subassembly. Such inserting may include electrically coupling the first conductive trace to a first electrical contact of the connector subassembly.

In other embodiments, there is provided a system that may include a cable having a first conductive lead. The system may also include a first connector subassembly having a first conductive trace electrically coupled to the first conductive lead. The first connector subassembly may also have an overmold about at least a first portion of the first conductive lead and about at least a first portion of the first conductive trace. The overmold may support the electrical coupling between the first conductive lead and the first conductive trace. The overmold may be a strain relief for the electrical coupling between the first conductive lead and the first conductive trace. The overmold may be configured to distribute a load applied to at least one of the cable and the first connector subassembly. The system may also include a first electrical contact and a body defining a cavity. The overmold may be positioned in the cavity and the first conductive trace may be coupled to the first electrical contact within the cavity.

In yet other embodiments, there is provided a system that may include a first conductive lead, a first conductive trace electrically coupled to the first conductive lead, a second conductive trace, and an overmold that may be configured to maintain a relative position between the first conductive trace and the second conductive trace. The system may also include a connector subassembly that may have a first electrical contact and a body defining a cavity. A portion of the second conductive trace may extend out of the overmold and may be coupled to the first electrical contact within the cavity.

In yet still other embodiments, there is provided a system that may include a first conductive trace, a second conductive trace, and an overmold that may be configured to maintain a relative position between the first conductive trace and the second conductive trace. The system may also include a conductive electronic component that may be electrically coupled to the first conductive trace and the second conductive trace. The conductive electronic component may include at least one of a thermal fuse, a thermal cut off ("TCO"), a resistor, and a capacitor.

BRIEF DESCRIPTION OF THE DRAWINGS

The above and other features of the invention, its nature, and various advantages will be more apparent upon consideration of the following detailed description, taken in conjunction with the accompanying drawings, in which like reference characters refer to like parts throughout, and in which.

DETAILED DESCRIPTION OF THE DISCLOSURE

Connector assemblies, and methods of manufacturing the same, that may include a body or shell overmolded about one or more electrical connections made between conductive leads of an electric cable and electrical contacts of the connector assembly are provided and described with reference to FIGS. 1-10.

Figure 1:
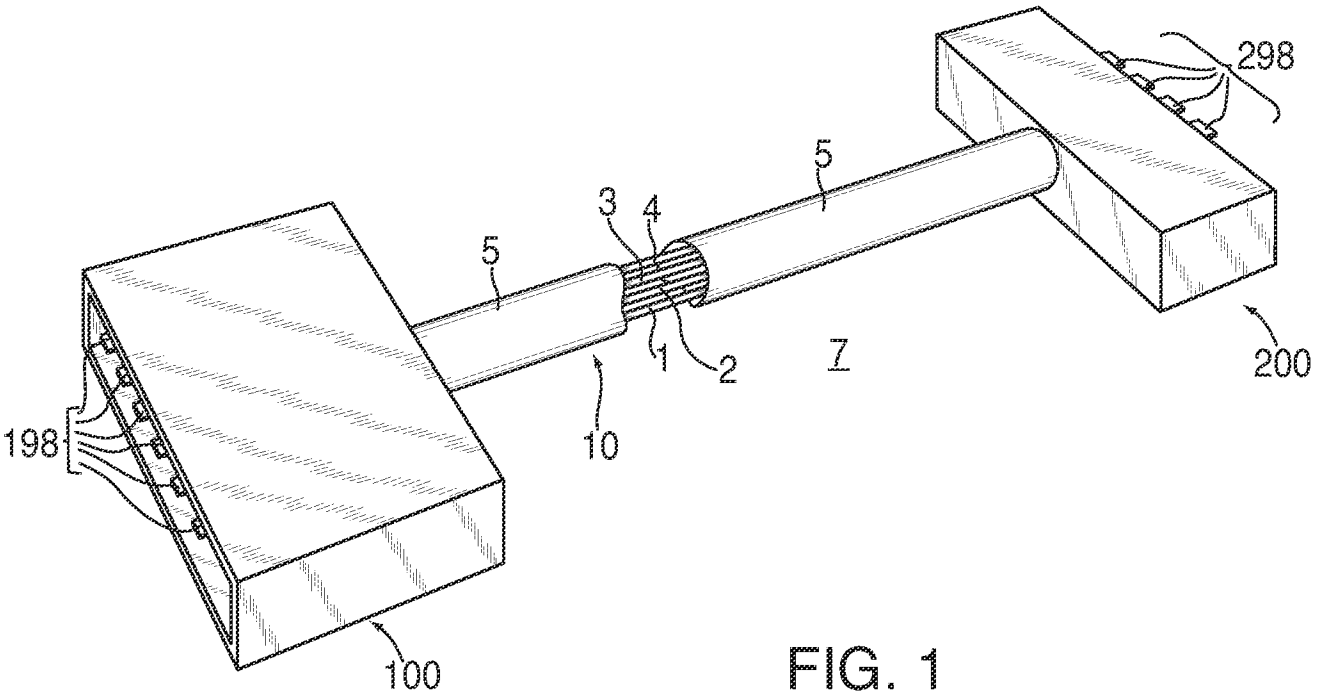
FIG. 1 is a top, front, right perspective view of an electric cable system constructed in accordance with some embodiments of the invention.

As shown in FIG. 1, for example, an electric cable system 7 may include an electric cable 10 and at least a first connector assembly 100. Cable 10 may include one or more conductive lines or leads (e.g., wires), each of which may extend from first connector assembly 100. In some embodiments, as shown in FIG. 1, electric cable system 7 may include first connector assembly 100 and a second connector assembly 200, and at least one of the conductive leads of cable 10 may extend between first connector assembly 100 and second connector assembly 200 for transferring data, power, and/or other electrical signal-types between electronic device input/output ("I/O") components coupled to the connector assemblies.

For example, cable 10 may include at least four conductive leads, such as a first conductive lead 1, a second conductive lead 2, a third conductive lead 3, and a fourth conductive lead 4, each of which may extend between first connector assembly 100 and second connector assembly 200. Cable 10 may also include a cable jacket 5 that may extend between connector assemblies 100 and 200 and that may surround and/or protect one or more of conductive leads 1-4. A portion of cable jacket 5 has been removed from FIG. 1 so that portions of conductive leads 1-4 of cable 10 may be shown in FIG. 1.

Connector assemblies 100 and 200 may each be configured to electrically couple one or more of conductive leads 1-4 to a number of electrical contacts of the connector assembly. The quantity, size, and relative positioning of these electrical contacts may vary between connector assemblies of cable system 7 and may determine the types of electronic device I/O components that can mate with the connector assemblies of cable system 7. For example, as shown in FIG. 1, first connector assembly 100 may include six (6) electrical contacts 198, while second connector assembly 200 may only include four (4) electrical contacts 298. Each one of connector assemblies 100 and 200 may be any suitable connector assembly type (e.g., a Universal Serial Bus ("USB") connector assembly, a 30-pin connector assembly, such as those provided by Apple Inc. of Cupertino, Calif., and the like) for mating and electrically communicating with any suitable electronic device I/O component (not shown). Therefore, in some embodiments, first connector assembly 100 may be a 30-pin connector assembly and second connector assembly 200 may be a USB connector assembly, such that conductive leads 1-4 of cable 10 may electrically couple two different types of electronic device I/O components to one another (e.g., a first electronic device I/O component configured to receive and communicate with a 30-pin connector assembly, and a second electronic device I/O component configured to receive and communicate with a USB connector assembly).

Figure 2:
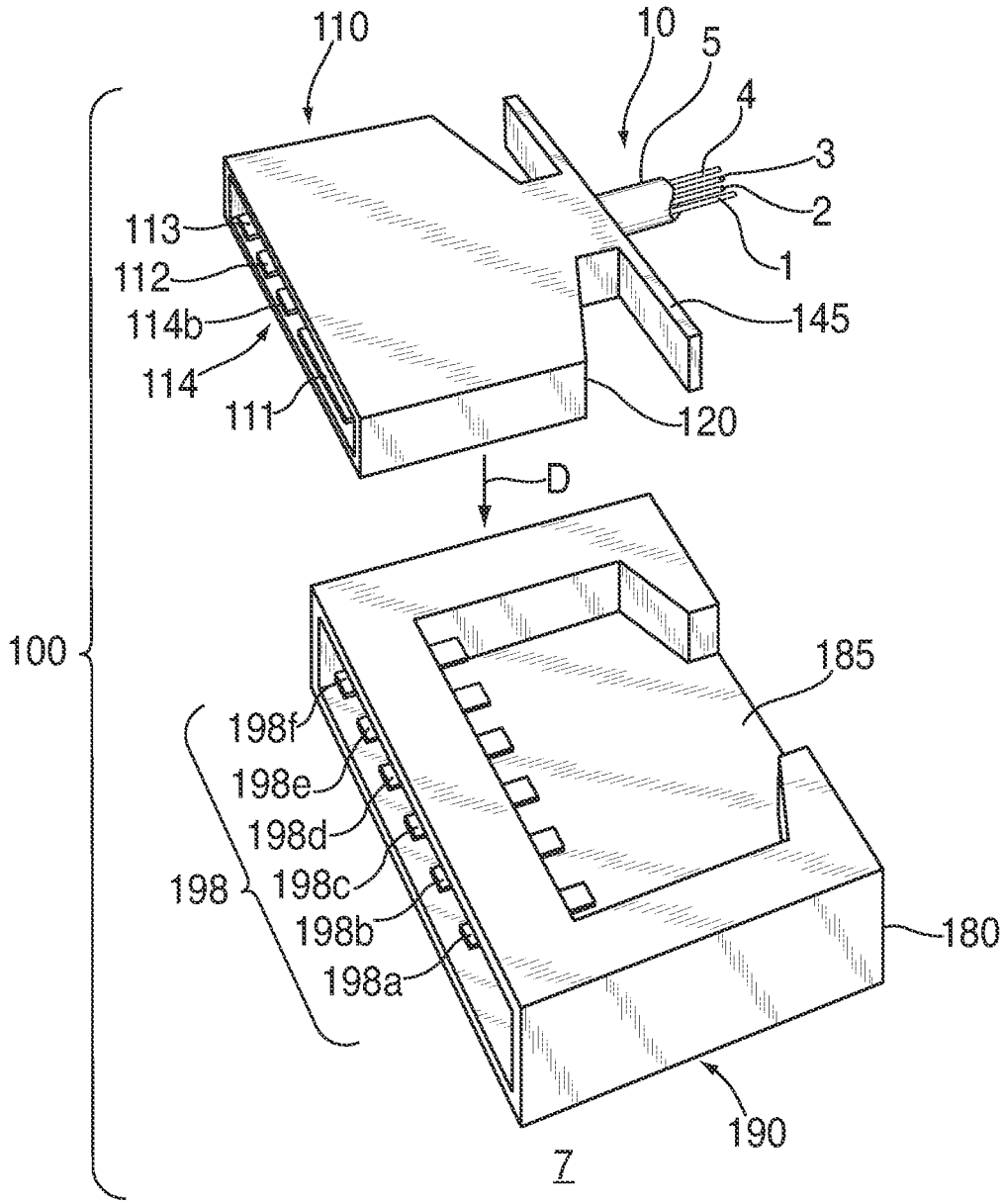
FIG. 2 is a top, front, right perspective exploded view of a first connector assembly of the cable system of FIG. 1, in accordance with some embodiments of the invention.
Figure 3:
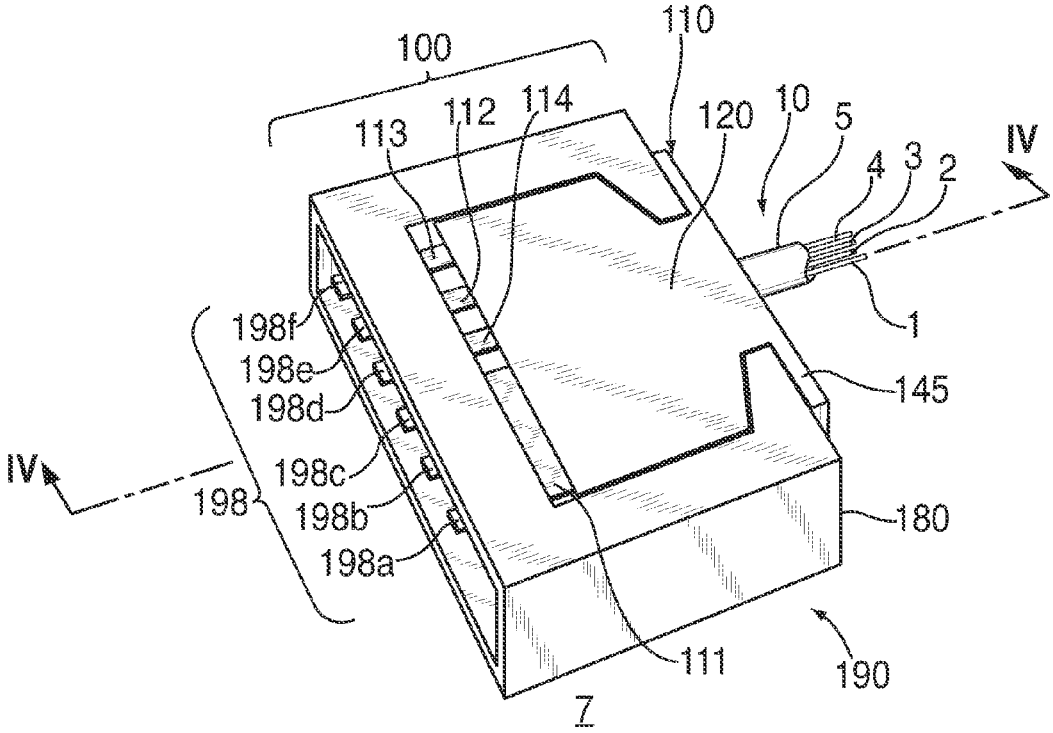
FIG. 3 is a top, front, right perspective non-exploded view of the first connector assembly of FIGS. 1 and 2, in accordance with some embodiments of the invention.
Figure 4:
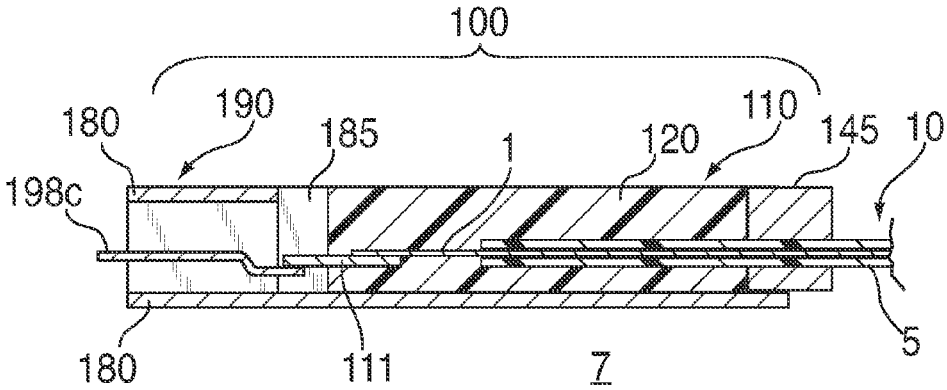
FIG. 4 is a partial cross-sectional view of the first connector assembly of FIGS. 1-3, taken from line IV-IV of FIG. 3, in accordance with some embodiments of the invention.
Figure 5:
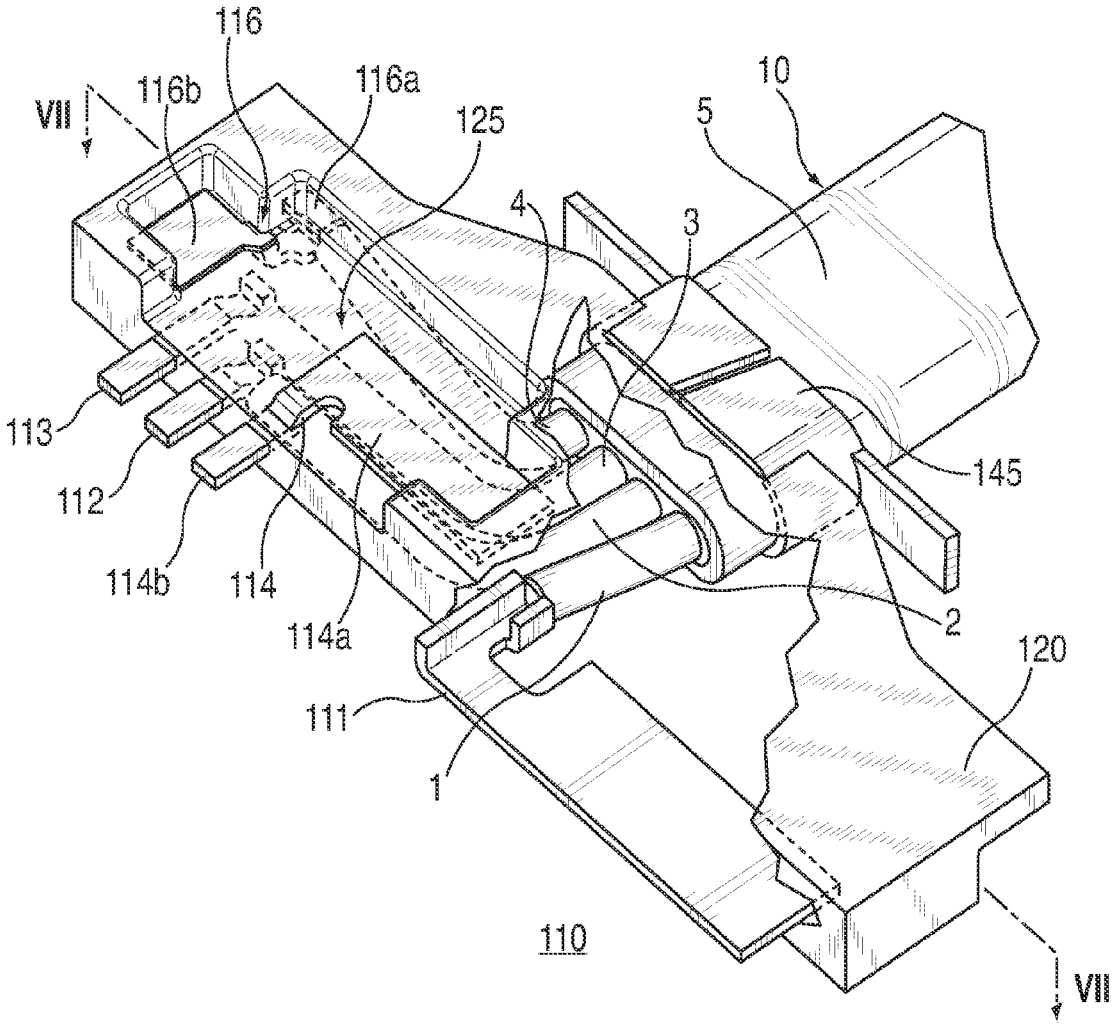
FIG. 5 is a top, front, right perspective view of a first connector subassembly of the first connector assembly of FIGS. 1-4, in accordance with some embodiments of the invention.
Figure 6:
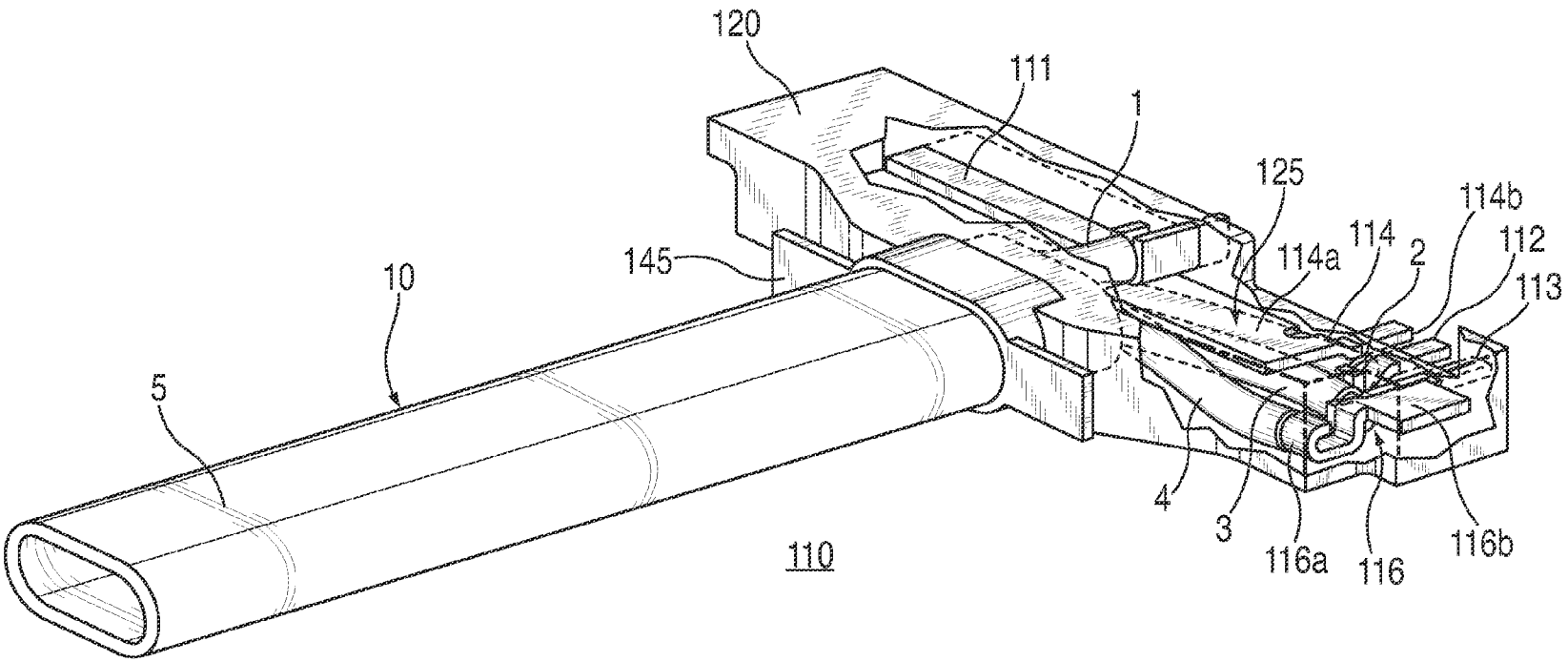
FIG. 6 is a top, back, left perspective view of the first connector subassembly of FIG. 5, in accordance with some embodiments of the invention.
Figure 7:
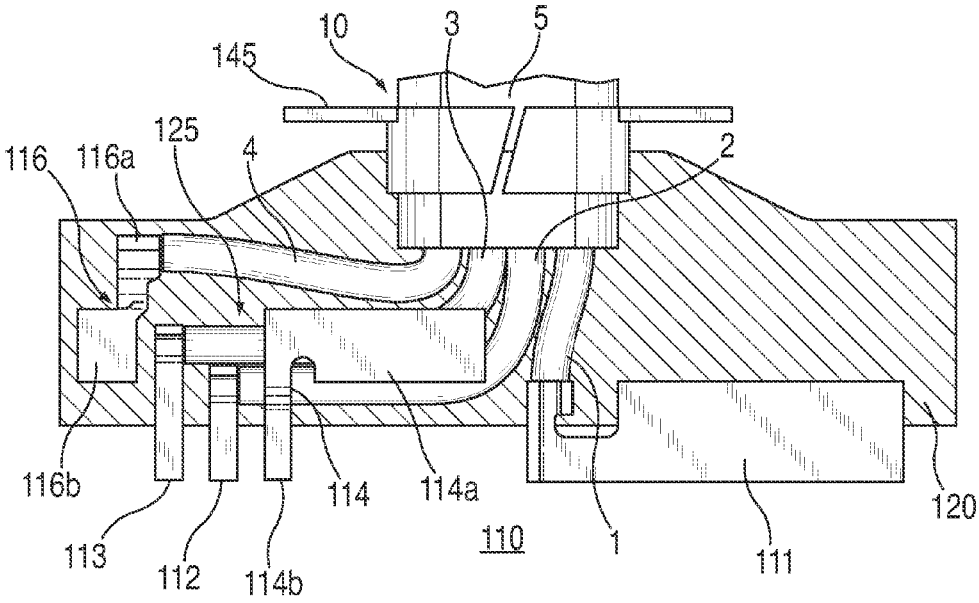
FIG. 7 is a top elevational view of the first connector subassembly of FIGS. 5 and 6, taken from line VII-VII of FIG. 5, in accordance with some embodiments of the invention.

As shown in FIGS. 2-4, for example, first connector assembly 100 of cable system 7 may include a first connector subassembly 110 and a second connector subassembly 190. First connector subassembly 110 may include one or more conductive contacts or traces, each of which may be electrically coupled to one of conductive leads 1-4 of cable 10. For example, as shown in FIG. 2, first connector subassembly 110 may include a first conductive trace 111 electrically coupled to first conductive lead 1, a second conductive trace 112 electrically coupled to second conductive lead 2, a third conductive trace 113 electrically coupled to third conductive lead 3, and a fourth conductive trace 114 electrically coupled to fourth conductive lead 4. The various ways in which conductive traces 111-114 may be electrically coupled to conductive leads 1-4 are described below with respect to FIGS. 5-9. Each one of conductive traces 111-114 may be metal or any other suitable conductive material for electrically coupling with a respective one of conductive leads 1-4. First connector subassembly 110 may also include a body 120, which may support the connections between conductive leads 1-4 and conductive traces 111-114. Moreover, first connector subassembly 110 may also include a cable crimp 145, which may help guide cable jacket 5 and conductive leads 1-4 into and/or hold cable jacket 5 and conductive leads 1-4 against body 120 of subassembly 110.

Second connector subassembly 190 may include one or more electrical contacts 198. For example, as shown in FIGS. 2-4, second connector subassembly 190 may include six (6) electrical contacts 198 (i.e., first electrical contact 198*a*, second electrical contact 198*b*, third electrical contact 198*c*, fourth electrical contact 198*d*, fifth electrical contact 198*e*, and sixth electrical contact 198*f*), although it is to be understood that second connector subassembly 190 may include any other suitable number of electrical contacts 198 depending on the type of electronic device I/O component to which connector assembly 100 is to be electrically coupled. Second connector subassembly 190 may also include a body 180 defining a cavity 185. Body 180 may be made of any suitable material, such as plastic or any other suitable non-conductive or insulative material, that may maintain electrical contacts 198 in their relative positions and expose at least a portion of each electrical contact 198 within cavity 185 for electrical coupling with first connector subassembly 110.

For example, as shown in FIGS. 2-4, a portion of each one of electrical contacts 198 may be exposed in cavity 185, such that when first connector subassembly 110 is inserted into cavity 185 of second connector subassembly 190 (e.g., inserted downwardly in the direction of arrow D of FIG. 2), each one of conductive traces 111-114 of first connector subassembly 110 may be electrically coupled with one or more electrical contacts 198 of second connector subassembly 190. In some embodiments, the number of conductive traces of first connector subassembly 110 may equal the number of electrical contacts 198 of second connector subassembly 190, such that each conductive trace may be electrically coupled to a respective electrical contact 198. However, in other embodiments, and as shown in FIGS. 2-4, the number of conductive traces of first connector subassembly 110 may be less than the number of electrical contacts 198 of second connector subassembly 190. In such embodiments, two or more electrical contacts 198 of second connector subassembly 190 may be electrically coupled to the same conductive trace of first connector subassembly 110.

For example, as shown in FIGS. 2-4, first conductive trace 111 of first connector subassembly 110 may be aligned with and electrically coupled to each one of electrical contacts 198*a*, 198*b*, and 198*c* of second connector subassembly 190, while second conductive trace 112 of first connector subassembly 110 may be aligned with and electrically coupled to electrical contact 198*e* of second connector subassembly 190, while third conductive trace 113 of first connector subassembly 110 may be aligned with and electrically coupled to electrical contact 198*f* of second connector subassembly 190, and while fourth conductive trace 114 of first connector subassembly 110 may be aligned with and electrically coupled to electrical contact 198*d* of second connector subassembly 190. Each electrical contact 198 of second connector subassembly 190 may be electrically coupled to a conductive trace of first connector subassembly 110 in any suitable manner including, but not limited to, laser welding, fusing, soldering, and the like.

The shape of cavity 185 of second connector subassembly 190 may be configured to substantially match the shape of body 120 of first connector subassembly 110. In some embodiments, body 120 may be positioned within cavity 185, such that first subassembly 110 and second subassembly 190 may interlock with one another and/or restrict the other's movement in one or more degrees or directions of freedom. For example, as shown in FIGS. 3 and 4, once body 120 is positioned within cavity 185, first subassembly 110 and second subassembly 190 may restrict the other's movement in at least one direction perpendicular to arrow D of FIG. 2. Moreover, when body 120 is positioned within cavity 185, one or more electrical contacts 198 of second connector subassembly 190 may be electrically coupled to one or more conductive traces 111-114 of first connector subassembly 110 (e.g., within cavity 185).

In addition to or instead of the shapes of cavity 185 and body 120 interlocking to hold subassemblies 110 and 190 in functional alignment, a cover or any other suitable component (not shown) may be positioned about at least portions of first connector subassembly 110 and second connector subassembly 190 to hold the subassemblies together to form first connector assembly 100. For example, a thermoplastic cover or overmold or adhesive wrap may be provided to hold subassemblies 110 and 190 together such that the electrical connections between electrical contacts 198 and conductive traces 111-114 may be maintained.

As mentioned above, and as shown in greater detail in FIGS. 5-9, for example, first connector subassembly 110 may include first conductive trace 111 electrically coupled to first conductive lead 1, second conductive trace 112 electrically coupled to second conductive lead 2, third conductive trace 113 electrically coupled to third conductive lead 3, and fourth conductive trace 114 electrically coupled to fourth conductive lead 4. For example, as shown in FIG. 4, an exposed end of first conductive lead 1 of cable 10 may be electrically coupled to a first portion of first conductive trace 111 of first connector subassembly 110 in any suitable manner including, but not limited to, crimping, fusing, welding, and the like. A second portion of first conductive trace 111 may be electrically coupled to one or more electrical contacts 198 of second connector subassembly 190 (e.g., electrical contacts 198*a*-198*c*, as shown in FIGS. 2-4). Similarly, an exposed end of second conductive lead 2 may be electrically coupled to a first portion of second conductive trace 112, while a second portion of second conductive trace 112 may be electrically coupled to one or more electrical contacts 198 of second connector subassembly 190 (e.g., electrical contact 198*e*, as shown in FIGS. 2-4). Similarly, an exposed end of third conductive lead 3 may be electrically coupled to a first portion of third conductive trace 113, while a second portion of third conductive trace 113 may be electrically coupled to one or more electrical contacts 198 of second connector subassembly 190 (e.g., electrical contact 198*f*, as shown in FIGS. 2-4).

Furthermore, in some embodiments, an exposed end of fourth conductive lead 4 may be electrically coupled to a first portion of fourth conductive trace 114, while a second portion of fourth conductive trace 114 may be electrically coupled to one or more electrical contacts 198 of second connector subassembly 190 (e.g., electrical contact 198*d*, as shown in FIGS. 2-4). However, in some embodiments, fourth conductive lead 4 of cable 10 may not be electrically coupled directly to fourth conductive trace 114 of first connector subassembly 110. Instead, fourth conductive lead 4 may be electrically coupled to fourth conductive trace 114 via one or more intermediary conductive components. For example, as shown in FIGS. 5-9, fourth conductive lead 4 may be electrically coupled (e.g., directly coupled) to an intermediate conductive trace 116 of first connector subassembly 110, and intermediate conductive trace 116 may be electrically coupled to fourth conductive trace 114 in various suitable ways. In some embodiments, intermediate conductive trace 116 may be electrically coupled to fourth conductive trace 114 through a conductive electronic component 118. As shown in FIGS. 5-9, for example, fourth conductive lead 4 of cable 10 may be electrically coupled directly to a first portion 116*a* of intermediate conductive trace 116, while conductive electronic component 118 may be electrically coupled to both a second portion 116*b* of intermediate conductive trace 116 and a first portion 114*a* of fourth conductive trace 114. A second portion 114*b* of fourth conductive trace 114 may be electrically coupled to one or more electrical contacts 198 of second connector subassembly 190 (e.g., electrical contact 198*d*, as shown in FIGS. 2-4).

Like conductive traces 111, 112, and 113, each one of fourth conductive trace 114 and intermediate conductive trace 116 may be metal or any other suitable conductive material for electrically coupling with a respective one of conductive leads 1-4 and/or electrical contacts 198. In some embodiments, conductive electronic component 118 may also be metal or any other suitable conductive material. However, in other embodiments, conductive electronic component 118 may be a more sophisticated conductive element including, but not limited to, a thermal fuse, a thermal cut off ("TCO"), a resistor, a capacitor, or the like. For example, conductive electronic component 118 may be a thermal fuse that may be configured to break the connection between intermediate conductive trace 116 and fourth conductive trace 114 if the temperature of conductive electronic component 118 rises above a certain threshold.

Figure 8:
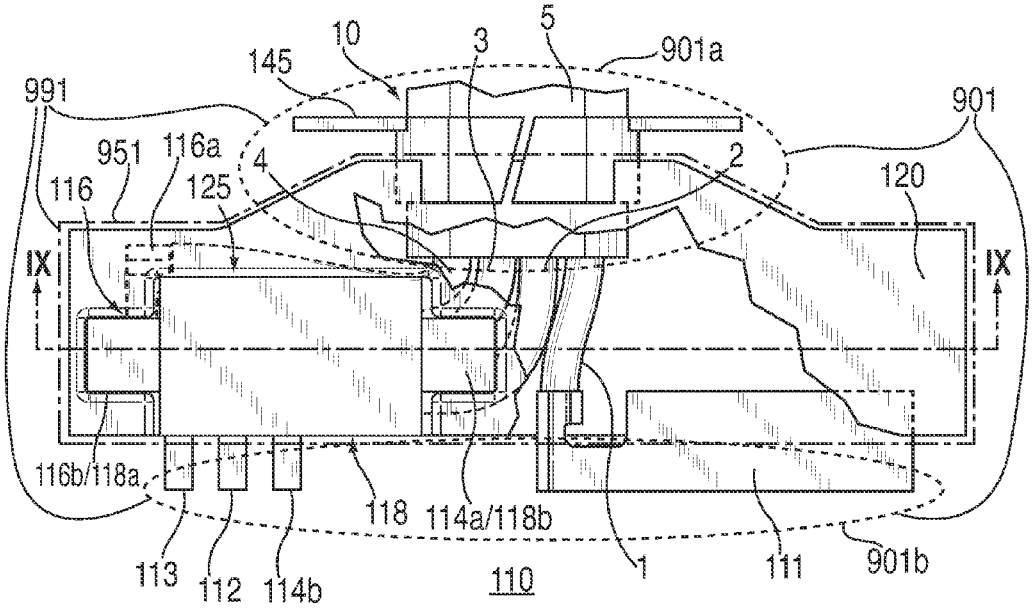
FIG. 8 is a top elevational view, similar to FIG. 7, of the first connector subassembly of FIGS. 5-7, but with an additional component, in accordance with some embodiments of the invention.
Figure 9:
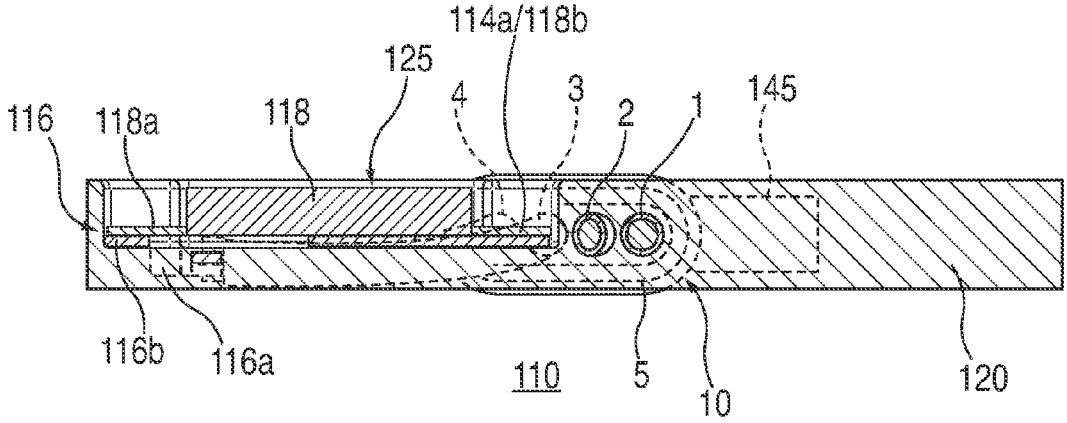
FIG. 9 is a cross-sectional view of the first connector subassembly of FIGS. 5-8, taken from line IX-IX of FIG. 8, in accordance with some embodiments of the invention.

Fourth conductive lead 4 may be electrically coupled to first portion 116*a* of intermediate conductive trace 116 in any suitable manner including, but not limited to, crimping, fusing, welding, and the like. Conductive electronic component 118 may be electrically coupled to each one of intermediate conductive trace 116 and fourth conductive trace 114 in any suitable way. However, thermal fusing and/or welding of conductive electronic component 118 to intermediate conductive trace 116 and/or fourth conductive trace 114 may be better than soldering, as soldering may raise the temperature of conductive component 118 above a threshold of component 118. For example, as shown in FIGS. 8 and 9, a first portion 118*a* of conductive component 118 may be electrically coupled to second portion 116*b* of intermediate conductive trace 116 and a second portion 118*b* of conductive component 118 may be electrically coupled to first portion 114*a* of fourth conductive trace 114. In some embodiments, the electrical coupling of portions 118*a* and 118*b* of conductive component 118 may each be achieved using thermal fusing or welding, followed by applying a non-conductive glue to the connection points.

Rather than providing one or more of conductive traces 111-114 or 116 as traces on a printed circuit board, traces 111-114 and 116 may be at least partially supported by body 120 of first connector subassembly 110. For example, shell or body 120 may be molded about and around the connections formed between conductive leads 1-4 and conductive traces 111-114 and 116. In some embodiments, a fixture assembly 901 may include one or more fixtures that may be used to temporarily hold conductive leads 1-4 and conductive traces 111-114 and 116 in their electrically coupled positions of FIGS. 5-9 while a material may be injected into a mold cavity 951 for forming overmolded shell or body 120 about and around the electrically coupled elements, as shown in FIGS. 5-9, for example. Body 120 may also be formed about or around at least a portion of cable jacket 5 and/or at least a portion of cable crimp 145, as shown in FIGS. 5-9.

In some embodiments, one or more fixtures may be used to temporarily hold any portion of cable 10 and/or any portion of first connector subassembly 110. For example, as shown in FIG. 8, a first fixture 901*a* of fixture assembly 901 may hold a portion of jacket 5 and/or a portion of crimp 145 and a second fixture 901*b* of fixture assembly 901 may hold a portion of one or more of conductive traces 111-114 (e.g., second portion 114*b* of fourth conductive trace 114). Such first and second fixtures of fixture assembly 901 may be held relative to one another to maintain each conductive lead of cable 10 (e.g., leads 1-4) and each conductive trace of first connector assembly 100 (e.g., traces 111-114 and 116) in their electrically coupled positions of FIGS. 5-9. In other embodiments, fixture assembly 901 may include only a single fixture. Alternatively, fixture assembly 901 may include more than two fixtures.

As also shown in FIG. 8, a mold cavity 951 may be positioned relative to each fixture of fixture assembly 901 and about and/or around at least a portion of one or more of the conductive traces of first connector assembly 100 and about and/or around at least a portion of one or more of the conductive leads of cable 10, while a material may be injected into mold cavity 951 for forming overmolded shell or body 120 about and around at least a portion of each of the electrically coupled elements, as shown in FIGS. 5-9, for example. In some embodiments, mold cavity 951 may include multiple distinct mold cavities that may be injected independently or at the same time in order to form body 120. In some embodiments, at least a portion of mold cavity 951 and at least one fixture of fixture assembly 901 may be incorporated into a single element. For example, first fixture 901*a*, second fixture 901*b*, and cavity 951 may all be provided as a single manufacturing element 991, as shown in FIG. 8. Body 120 may be configured to maintain the relative positions held by fixture assembly 901 of one or more portions of cable 10 and/or one or more portions of first connector subassembly 110.

Body 120 may be molded from any suitable material including, but not limited to, soft elastomers, thermoplastics, thermosetting plastic materials, and the like. When the mold material for body 120 is injected into a mold cavity for forming body 120 of first connector subassembly 110, the material can fill the mold cavity and flow around conductive leads 1-4 and/or conductive traces 111-114 and 116. Body 120 may be formed using different injection molding materials for different portions of body 120. For example, a softer material may be used for inner portions of body 120 and a harder material may be used to mold an outer portion of body 120. Different portions of mold cavity 951 may be filled with different injection molding materials or molding materials with different properties. It is to be appreciated that molded body 120 may be formed to have any suitable shape simply by designing a cavity mold with desired dimensions. Unlike printed circuit boards that are often difficult to customize to a particular shape, molded body 120 may be formed to have a unique shape that may correspond to and interlock with another component, such as cavity 185 of second connector subassembly 190. By enabling a close fit between body 120 of connector subassembly 110 and cavity 185 of connector subassembly 190, the two subassemblies may better maintain the functional alignment and electrical connections between conductive traces 111-114 of first connector subassembly 110 and electrical contacts 198 of second connector subassembly 190.

Overmolded body 120 may support the electrical connections made between leads 1-4 and traces 111-114 and 116, such that body 120 may act as a strain relief for the termination of leads 1-4 at first connector subassembly 110. Unlike printed circuit boards, molded body 120 may be at least partially formed of a material that is soft or malleable enough to flex or otherwise distribute a load or pressure applied to cable 10 and/or first connector assembly 100 of system 7 that might otherwise threaten the integrity of the connections between the leads and traces. Overmolded body 120 may also be formed about leads 1-4 and traces 111-114 and 116 to appropriately manage and route those elements through body 120, such that their electrical connections are properly supported and such that the positioning of the portions of traces 111-114 extending outwardly from body 120 (e.g., portion 114*b*) may be properly maintained for functional alignment with other components (e.g., contacts 198 of second connector subassembly 190).

Body 120 may be molded about leads 1-4 and traces 111-114 and 116 before conductive component 118 may be electrically coupled to traces 114 and 116. For example, as shown in FIGS. 5-9, a body cavity or recess 125 may be formed in body 120 that may expose at least second portion 116*b* of trace 116 and first portion 114*a* of trace 114. Body recess 125 may be dish shaped or any other suitable shape that may allow conductive component 118 to be electrically coupled to traces 114 and 116 after body 120 has been formed. Recess 125 may be formed after at least a first portion of body 120 has been formed. In some embodiments, a second portion of body 120 (not shown) may be molded on top of conductive component 118 after or concurrently with the other portions of body 120 shown in FIGS. 5-9. Body 120 may be a mold for managing and/or routing wires or electrical traces from one location to another (e.g., for electrical coupling or termination). Body 120 may be a mold that can act as a strain relief for electrically coupled paths.

Figure 10:
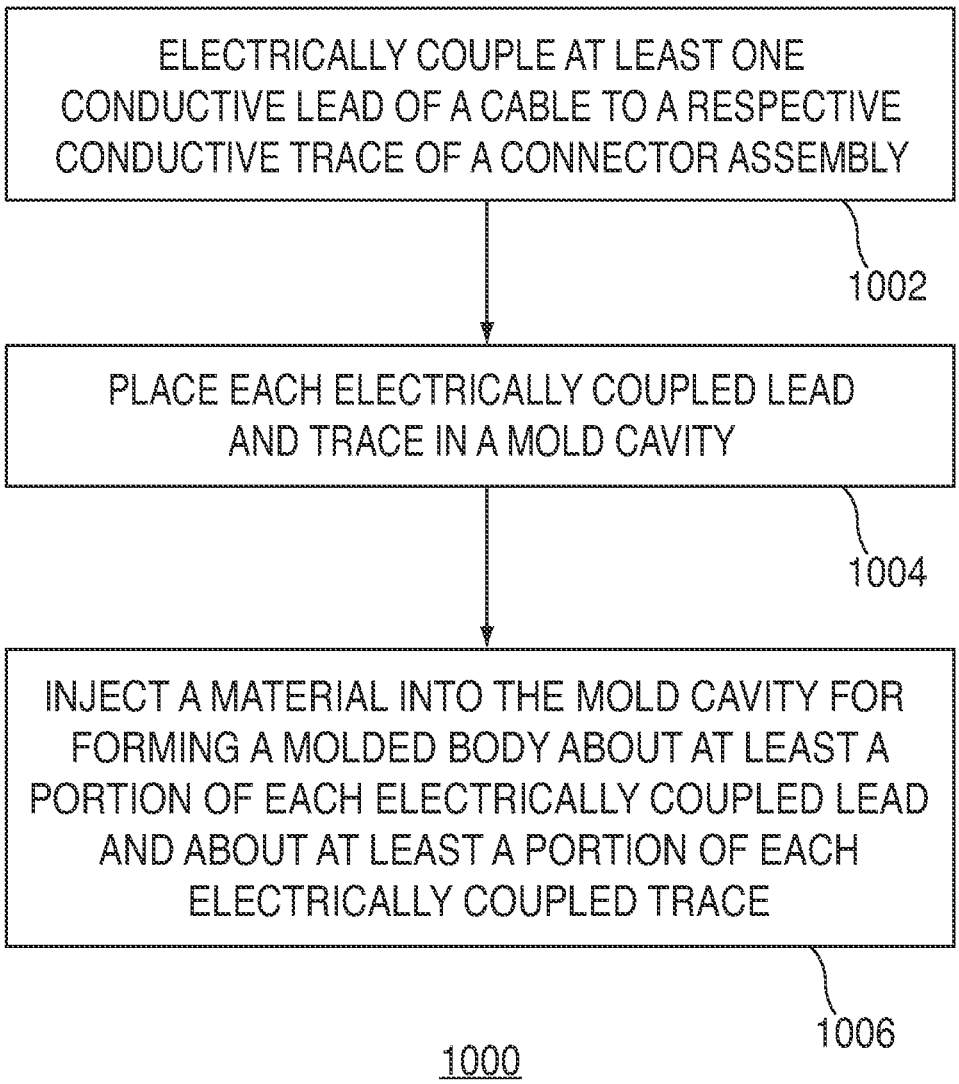
FIG. 10 is a flowchart of an illustrative process for manufacturing a connector assembly, in accordance with some embodiments of the invention.

FIG. 10 is a flowchart of an illustrative process 1000 for manufacturing a connector assembly (e.g., first connector subassembly 110 of FIGS. 5-9). At step 1002, at least one conductive lead of a cable is electrically coupled to a respective conductive trace of the assembly. For example, each conductive lead of cable 10 may be crimped, fused, welded, soldered, or otherwise electrically coupled to a conductive trace of first connector subassembly 110. Next, at step 1004, at least one electrically coupled lead and trace may be positioned within a mold cavity. For example, one or more fixtures may be used to hold the electrically coupled lead and trace in a predetermined configuration within a mold cavity. Next, at step 1006, a material may be injected into the mold cavity for forming a molded body about at least a portion of each electrically coupled lead and about at least a portion of each electrically coupled trace.

For example, a connector assembly body may be molded about at least a portion of each lead and each trace for holding each electrically coupled lead and trace in a particular configuration. A material may be injected into a mold cavity and may harden for maintaining the leads and traces in such a particular configuration. In some embodiments, the connector assembly body molded at step 1006 may include a recess, or such a recess may be formed into the body after step 1006, for exposing at least a portion of not only a first trace that is electrically coupled to a first lead but also at least a portion of a second trace. In such embodiments, a conductive component may then be positioned within the recess and coupled to those two at least partially exposed traces. For example, a thermal fuse may be electrically coupled to two such traces while enabling the electrical connection to be broken when the temperature of the thermal fuse exceeds a certain temperature.

It is understood that the steps shown in process 1000 of FIG. 10 are merely illustrative and that existing steps may be modified or omitted, additional steps may be added, and the order of certain steps may be altered. For example, in some embodiments, the electrical coupling of a trace and lead at step 1002 may be performed after the trace and lead are positioned within a mold cavity at step 1004, but before the mold cavity is injected at step 1006.

The previously described embodiments are presented for purposes of illustration and not of limitation. It is understood that one or more features of an embodiment can be combined with one or more features of another embodiment to provide systems and/or methods without deviating from the spirit and scope of the invention.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The above-described embodiments of the invention are presented for purposes of illustration and not of limitation.

What is claimed is:

1. A method for constructing a connector assembly for a cable, comprising:

electrically coupling a first conductive lead of the cable to a first conductive trace of the connector assembly;

electrically coupling the first conductive trace of the connector assembly to a first portion of a second conductive trace of the connector assembly;

injecting a first material into a mold cavity for forming a molded body about at least a portion of the first conductive lead and about at least a portion of the first and second conductive traces without covering a second portion of the second conductive trace, the second portion extending outwardly from the molded body and configured to be electrically coupled to one or more contacts of a second connector; and wherein the molded body is configured to: expose at least a first portion of the first conductive trace; and expose at least the first portion of the second conductive trace.

2. The method of claim 1, further comprising placing the at least a portion of the first conductive lead and the at least a portion of the first conductive trace into the mold cavity before the electrically coupling.

3. The method of claim 1, further comprising placing the at least a portion of the first conductive lead and the at least a portion of the first conductive trace into the mold cavity after the electrically coupling.

4. The method of claim 1, further comprising electrically coupling the first conductive trace to the first portion of the second conductive trace of the connector assembly after the injecting.

5. The method of claim 1, further comprising electrically coupling the first conductive trace to the first portion of the second conductive trace of the connector assembly before the injecting.

6. The method of claim 1, further comprising electrically coupling a conductive electronic component to the first conductive trace and to the first portion of the second conductive trace of the connector assembly.

7. The method of claim 6, wherein the conductive electronic component comprises at least one of a thermal fuse, a thermal cut off ("TCO"), a resistor, and a capacitor.

8. The method of claim 6, wherein the conductive electronic component is configured to break an electrical connection between the first conductive trace and the second conductive trace when a temperature of the conductive electronic component rises above a certain threshold.

9. The method of claim 1, further comprising forming a recess in the molded body.

10. The method of claim 9, further comprising positioning a conductive electronic component within the recess.

11. The method of claim 10, wherein the positioning comprises electrically coupling the conductive electronic component to the first portion of the first conductive trace and to the first portion of the second conductive trace of the connector assembly.

12. The method of claim 10, further comprising injecting a second material into a second mold cavity for forming a second molded body about at least a portion of the conductive electronic component.

13. The method of claim 1, wherein the molded body supports an electrical connection between the first conductive lead and the first conductive trace.

14. The method of claim 1, further comprising inserting the molded body into a cavity of a connector subassembly.

15. The method of claim 14, wherein the inserting comprises electrically coupling the first conductive trace to a first electrical contact of the connector subassembly.

16. A system comprising:

a cable comprising a first conductive lead; and a first connector subassembly comprising:

a first conductive trace electrically coupled to the first conductive lead and electrically coupled to a first portion of a second conductive trace of the first connector subassembly;

an overmold about at least a first portion of the first conductive lead, about at least a portion of the first conductive trace and about at least a portion of the second conductive trace without covering a second portion of the second conductive trace, the second portion extending outwardly from the overmold and configured to be electrically coupled to one or more contacts of a second connector subassembly; and wherein the overmold is configured to expose at least a first portion of the first conductive trace and expose at least a first portion of the second conductive trace.

17. The system of claim 16, wherein the overmold supports the electrical coupling between the first conductive lead and the first conductive trace.

18. The system of claim 16, wherein the overmold is a strain relief for the electrical coupling between the first conductive lead and the first conductive trace.

19. The system of claim 16, wherein the overmold is configured to distribute a load applied to at least one of the cable and the first connector subassembly.

20. The system of claim 16, wherein a second portion of the first conductive trace extends out of the overmold.

21. The system of claim 16, wherein the second connector subassembly comprises: a first electrical contact; and a body defining a cavity.

22. The system of claim 21, wherein the overmold is positioned within the cavity.

23. The system of claim 21, wherein the first conductive trace is coupled to the first electrical contact within the cavity.

24. The system of claim 21, wherein, when the overmold is positioned within the cavity, the body restricts the movement of the overmold in at least one direction of freedom.

25. A system comprising:

a first conductive lead;

a first conductive trace electrically coupled to the first conductive lead;

a second conductive trace having a first portion electrically coupled to the first trace;

an overmold configured to maintain a relative position between the first conductive trace and the second conductive trace without covering a second portion of the second conductive trace, the second portion extending outwardly from the overmold and configured to be electrically coupled to one or more contacts of a second connector; and wherein the overmold is further configured to: expose at least a first portion of the first conductive trace; and expose at least the first portion of the second conductive trace.

26. The system of claim 25 further comprising a connector subassembly comprising:

a first electrical contact; and a body defining a cavity, wherein the second portion of the second conductive trace is coupled to the first electrical contact within the cavity.

27. A system comprising:

a first conductive lead;

a first conductive trace electrically coupled to the first conductive lead;

a second conductive trace having a first portion electrically coupled to the first trace; and an overmold configured to maintain a relative position between the first conductive trace and the second conductive trace without covering a second portion of the second conductive trace, the second portion extending outwardly from the overmold and configured to be electrically coupled to one or more contacts of a second connector;

wherein the overmold is further configured to: expose at least a first portion of the first conductive trace; and expose at least the first portion of the second conductive trace; and wherein a conductive element is electrically coupled to the first portion of the first conductive trace and to the first portion of the second conductive trace.

28. A system comprising:

a first conductive trace;

a second conductive trace;

an overmold configured to maintain a relative position between the first conductive trace and the second conductive trace;

a conductive electronic component electrically coupled to the first conductive trace and the second conductive trace, wherein the conductive electronic component comprises at least one of a thermal fuse, a thermal cut off ("TCO"), a resistor, and a capacitor; and wherein the overmold is further configured to: expose at least a first portion of the first conductive trace; and expose at least a first portion of the second conductive trace.

* * * * *